US010702443B2

(12) United States Patent
Wu

(10) Patent No.: US 10,702,443 B2
(45) Date of Patent: Jul. 7, 2020

(54) MASSAGE DEVICE

(71) Applicant: Shanghai Rongtai Health Technology Corporation Limited, Shanghai (CN)

(72) Inventor: Dong-Her Wu, Chang Hua Hsien (TW)

(73) Assignee: Shanghai Rongtai Health Technology Corporation Limited, Shanghai (CN)

( * ) Notice: Subject to any disclaimer, the term of this patent is extended or adjusted under 35 U.S.C. 154(b) by 429 days.

(21) Appl. No.: 15/439,471

(22) Filed: Feb. 22, 2017

(65) Prior Publication Data

US 2017/0246074 A1 Aug. 31, 2017

(30) Foreign Application Priority Data

Feb. 26, 2016 (TW) ..... 105202724 U

(51) Int. Cl.

*A61H 7/00* (2006.01)
*A61H 15/00* (2006.01)
*A61H 39/04* (2006.01)

(52) U.S. Cl.

CPC ..... *A61H 7/007* (2013.01); *A61H 15/0078* (2013.01); *A61H 39/04* (2013.01); *A61H 2201/0149* (2013.01); *A61H 2201/12* (2013.01); *A61H 2201/1215* (2013.01); *A61H 2201/1445* (2013.01); *A61H 2201/1481* (2013.01); *A61H 2201/1614* (2013.01); *A61H 2201/1623* (2013.01); *A61H 2201/1669* (2013.01); *A61H 2201/1678* (2013.01); *A61H 2203/0425* (2013.01)

(58) Field of Classification Search

CPC ..... A61H 7/007; A61H 2201/0149; A61H 2201/1445; A61H 2201/1454; A61H 2201/1481

See application file for complete search history.

(56) References Cited

U.S. PATENT DOCUMENTS 5,462,516 A * 10/1995 Anderson ..... A61H 15/0078 601/112
6,551,259 B1 * 4/2003 Wu ..... A61H 37/00 601/101
6,808,500 B1 * 10/2004 Cheng-Yi ..... A61H 15/0078 601/102

(Continued)

FOREIGN PATENT DOCUMENTS

DE 202014105526 U1 * 2/2015 ..... A61H 39/04

*Primary Examiner* — Timothy A Stanis
*Assistant Examiner* — Charles M Vivian
(74) *Attorney, Agent, or Firm* — Karin L. Williams; Mayer & Williams PC

(57) ABSTRACT

A massage device includes a base, a drive unit, and a transmission unit. The drive unit is coupled to the base. The transmission unit is disposed at one side of the base. The drive unit includes a drive member to drive a rotary shaft for driving massage members. One end of the rotary shaft is provided with a unidirectional bearing and a first bevel gear. The unidirectional bearing is able to control the rotation of the first bevel gear. The transmission unit includes two positioning blocks and a worm shaft connected between the two positioning blocks. The worm shaft is provided with a second bevel gear and a movable member thereon. The first bevel gear meshes with the second bevel gear. When the first bevel gear is rotated, the second bevel gear is driven to link other parts so that the drive unit can slide on the base.

6 Claims, 9 Drawing Sheets

(56) References Cited

U.S. PATENT DOCUMENTS

| | | | | |
|---|---|---|---|---|
| 7,052,477 | B2 * | 5/2006 | Wu | A61H 37/00 601/103 |
| 8,083,697 | B2 * | 12/2011 | Wu | A61H 7/007 601/90 |
| 8,480,603 | B2 * | 7/2013 | Chen | A61H 15/0078 601/134 |
| 8,974,404 | B2 * | 3/2015 | Chen | A61H 7/004 601/101 |
| 9,216,135 | B2 * | 12/2015 | Chen | A61H 7/007 |
| 2003/0089196 | A1 * | 5/2003 | Wu | F16D 41/08 74/665 F |
| 2011/0160627 | A1 * | 6/2011 | Huang | A61H 7/004 601/46 |
| 2013/0283948 | A1 * | 10/2013 | Chen | A61H 7/007 74/89.28 |
| 2015/0073320 | A1 * | 3/2015 | Wu | A61H 39/04 601/116 |

* cited by examiner

MASSAGE DEVICE

FIELD OF THE INVENTION

The present invention relates to a massage device, and more particularly to a drive unit able to provide a fixed-point massage and a movable massage.

BACKGROUND OF THE INVENTION

With modern people's growing concern about the quality of life, in order to maintain the basic living expenses, the working hours are required more and more. The prolongation of the working hours changes people's lifestyle. In addition to overtime work, it is easy to cause occupational injuries due to repetitive motion. Therefore, it is an important task to relieve pressure timely through various means. In general, pressure relief equipment is used to achieve the elimination of stress. That is, a massage may relax the muscles so that the body and mind can reduce the burden.

Conventional massage apparatuses include a massage chair, a shoulder and neck massage device, an arm or a leg massage machine and the like. The massage means can be diversified. A massage chair is the most common. The back of the massage chair is provided with a massage mechanism. The massage mechanism is driven by a drive motor, such that the massage mechanism can provide a fixed-point massage. However, each user's body is different from each other, and the part to be massaged varies from person to person. Therefore, the position for kneading cannot be changed to meet the user's need, which is a big problem. Therefore, an improved massage machine is developed accordingly. In addition to the fixed-point local massage, the massage mechanism of the improved massage machine can be moved up and down for a massage according to the user's need so as to fit a variety of the user's stature, not limited to a partial massage. But, the conventional massage mechanism able to move back and forth for a fixed-point massage and a kneading massage is usually driven by a motor, so that the massage mechanism can be moved to a certain position as desired. However, the rotation of the massage mechanism needs using another motor for various massages after the drive device is stopped. The design of the structure requires two motors. The cost is higher.

The conventional massage device cannot effectively cooperate with the user's stature to achieve the optimum massage and kneading position. Although the improved massage device can be reciprocated and provide a fixed-point massage and a kneading massage, it is necessary to use two motors to move the massage mechanism or to move the massage mechanism to a certain position for a variety of independent massages after the drive device is stopped. The structure needs to use two motors as a driver, resulting in high cost.

Accordingly, the inventor of the present invention has devoted himself based on his many years of practical experiences to solve these problems.

SUMMARY OF THE INVENTION

The primary object of the present invention is to provide a massage device. The massage device comprises a base, a drive unit, and a transmission unit. The base includes a first positioning plate and a second positioning plate thereon. Upper and lower ends of the base are formed with a pair of notches. The drive unit includes a main seat. The bottom of the main seat has an engaging recess. A drive member is provided on the main seat. The drive member is provided with a rotary shaft penetrating the drive member. Two ends of the rotary shaft are inserted through pivot holes of a pair of massage members in an eccentric manner, so that the massage members can be properly deflected and turned about the pivot holes respectively. One of the two ends of the rotary shaft is further connected with a unidirectional bearing and a first bevel gear. Upper and lower ends of each massage member are provided with massage bodies, respectively. The engaging recess at the bottom of the main seat is engaged with the first positioning plate and one side of the main seat is against the second positioning plate, such that the drive unit can slide up and down on the base. The transmission unit is secured on one side of the base. The transmission unit includes two positioning blocks and a worm shaft connected between the two positioning blocks. The worm shaft is formed with a cross screw thread thereon. The worm shaft is provided with a second bevel gear and a movable member thereon. The movable member is driven by the second bevel gear. The movable member includes a linkage member therein. An accommodation groove is defined between the second bevel gear and the movable member. The first bevel gear meshes with the second bevel gear to form a linkage relationship. The linkage member is engaged with the cross screw thread. A baffle plate is provided above the drive member of the drive unit. Upper and lower ends of the baffle plate are positioned at the pair of notches of the base. The drive member drives the rotary shaft to rotate, so that the massage members are properly deflected and turned for the massage bodies to perform a shiatsu massage and a kneading massage. When the rotary shaft is rotated clockwise, the unidirectional bearing is also rotated clockwise to drive the first bevel gear. The first bevel gear drives the second bevel gear to rotate the movable member. The linkage member inside the movable member meshes with the cross screw thread. The movable member is moved along the cross screw thread to bring the drive unit to move up and down on the base while the movable member is turned along with the second bevel gear. When the rotary shaft is rotated counterclockwise, the unidirectional bearing stops running so that the drive unit is kept at a certain position and the massage members perform a shiatsu massage and a kneading massage.

The massage device of the present invention uses the drive unit to drive the rotary shaft, allowing the massage members to independently perform a massage. The rotary shaft is connected with the unidirectional bearing. In addition to providing a fixed-point massage, the first bevel gear meshes with the second bevel gear for the drive unit to slide up and down on the base, without any additional independent power, so as to reach the optimum position for a shiatsu massage and a kneading massage according to the user's stature. Thereby, the cost can be reduced.

DETAILED DESCRIPTION OF THE PREFERRED EMBODIMENTS

Figure 1:
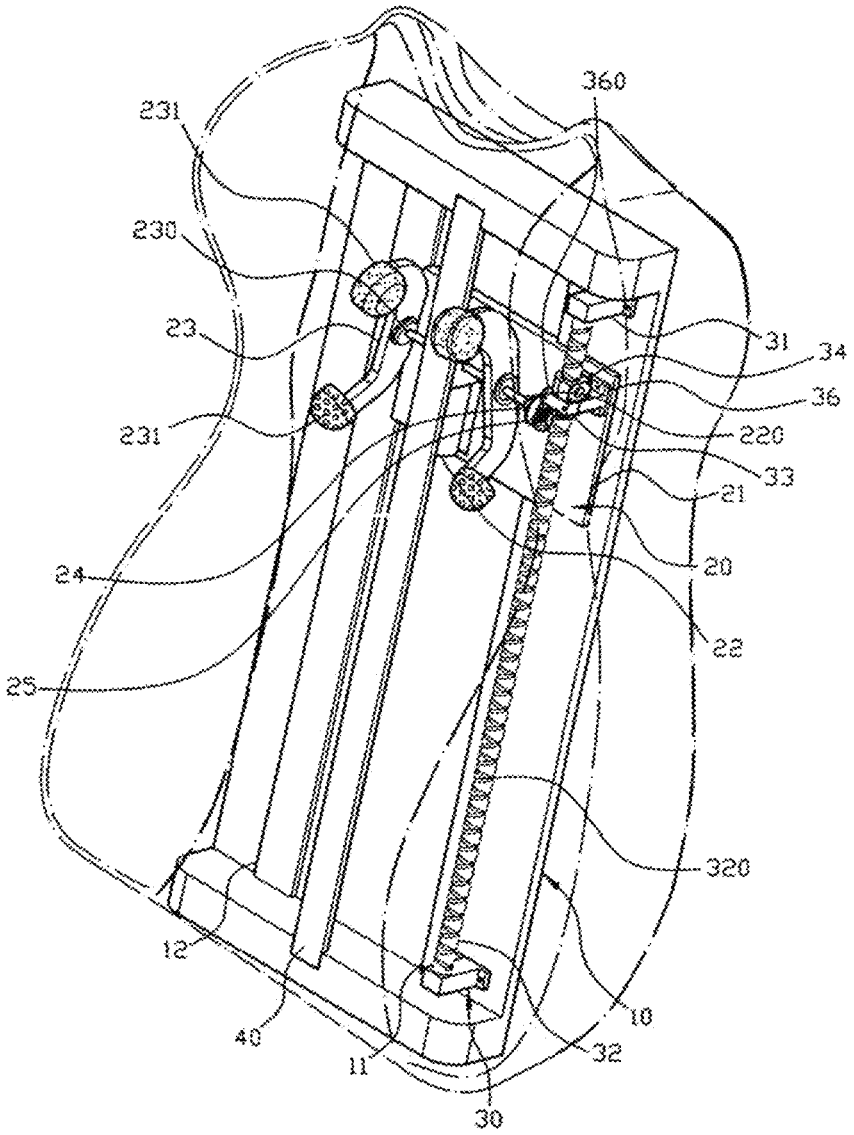
FIG. 1 is a schematic view of the present invention mounted on a massage chair.
Figure 2:
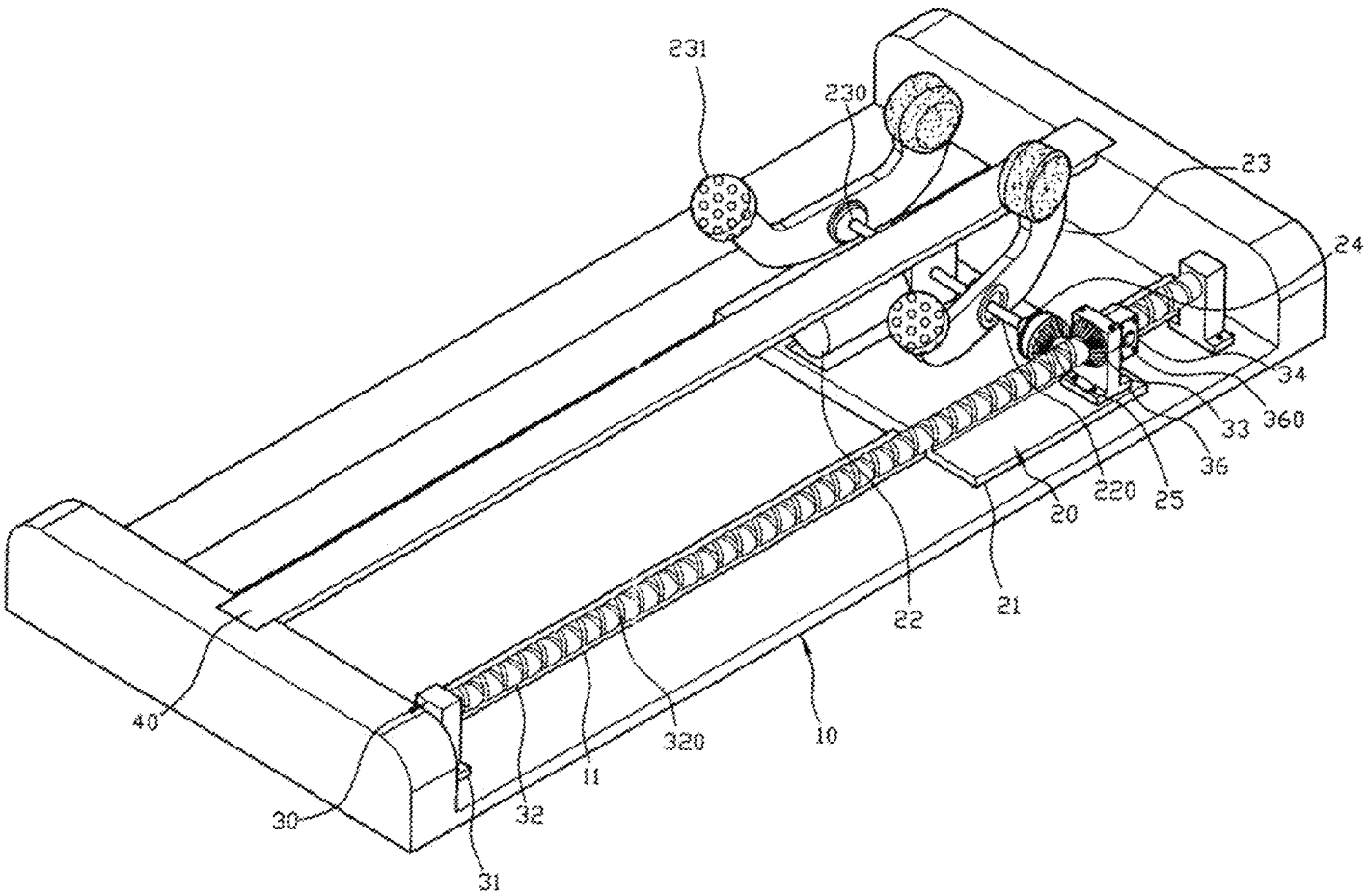
FIG. 2 is a perspective view of the present invention.

Embodiments of the present invention will now be described, by way of example only, with reference to the accompanying drawings.

As shown in FIG. 1 to FIG. 4, a massage device in accordance with an embodiment of the present invention comprises a base (10), a drive unit (20), and a transmission unit (30).

The base (10) includes a first positioning plate (11) and a second positioning plate (12) thereon. Upper and lower ends of the base (10) are formed with a pair of notches (13).

The drive unit (20) includes a main seat (21). The bottom of the main seat (21) has an engaging recess (210). A drive member (22) is provided on the main seat (21). The drive member (22) is provided with a rotary shaft (220) penetrating the drive member (22). Two ends of the rotary shaft (220) are inserted through pivot holes (230) of a pair of massage members (23) in an eccentric manner, so that the massage members (23) can be properly deflected and turned about the pivot holes (230) respectively. One of the two ends of the rotary shaft (220) is further connected with a unidirectional bearing (24) and a first bevel gear (25). The unidirectional bearing (24) includes an inner ring (240) and an outer ring (241) to receive the inner ring (240) therein. The inner ring (240) is threadedly connected to the rotary shaft (220). The inner ring (240) is rotated only in one direction relative to the outer ring (241). The first bevel gear (25) has an accommodation space (250) therein. The outer ring (241) is secured in the accommodation space (250) so that the first bevel gear (25) is rotated together with the outer ring (241). Upper and lower ends of each massage member (23) are provided with massage bodies (231), respectively. The transmission unit (30) includes two positioning blocks (31) and a worm shaft (32) connected between the two positioning blocks (31). The worm shaft (32) is formed with a cross screw thread (320) thereon. The worm shaft (32) is provided with a second bevel gear (33) and a movable member (34) thereon. The movable member (34) is driven by the second bevel gear (33). The movable member (34) includes a linkage member (340) therein. The bottom of the linkage member (340) is biased by a spring (341). The spring (341) abuts against a positioning piece (342). The positioning piece (342) is fixed to the movable member (34) with a screw (343).

Figure 3:
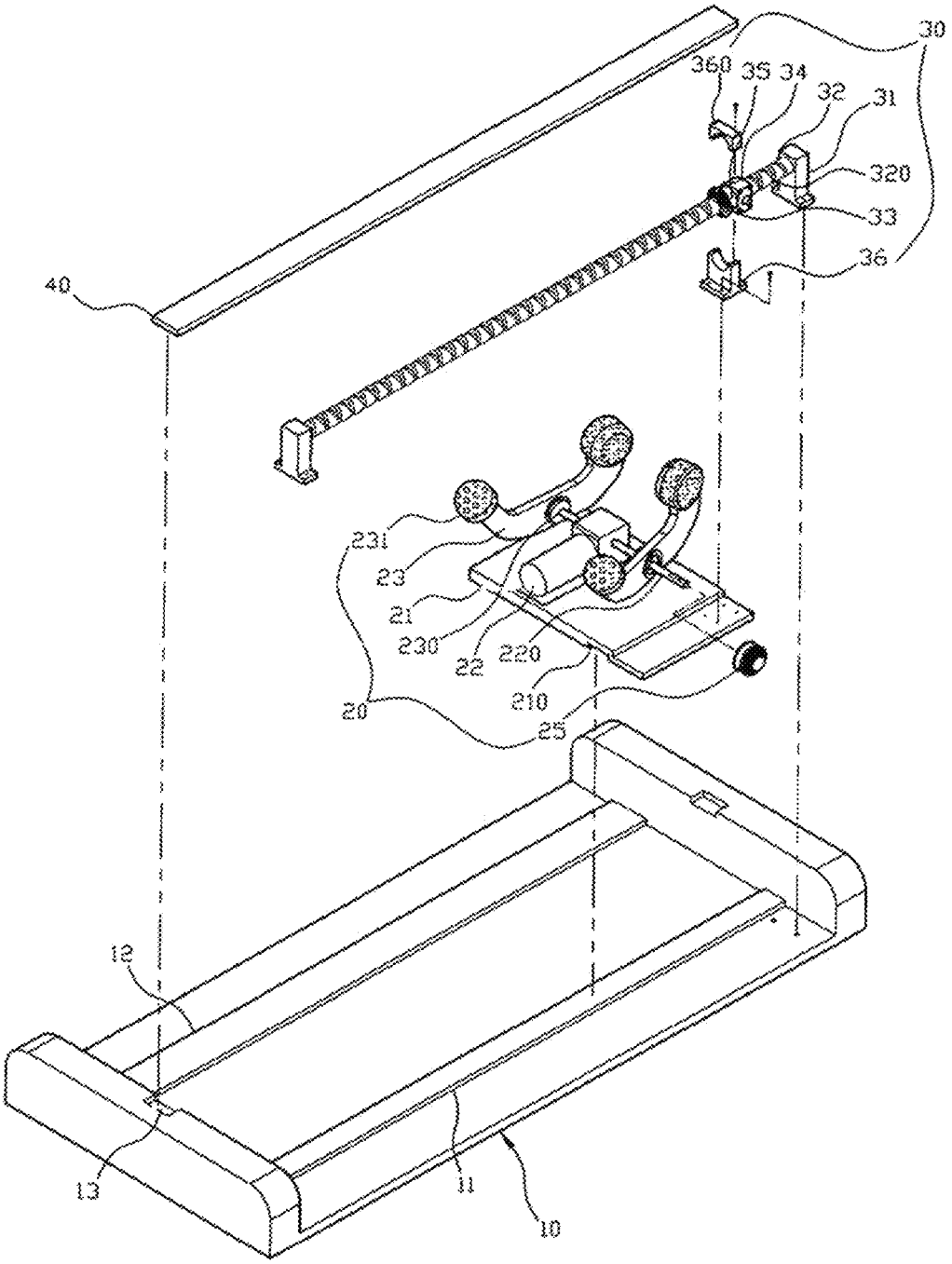
FIG. 3 is an exploded view of the present invention.
Figure 4:
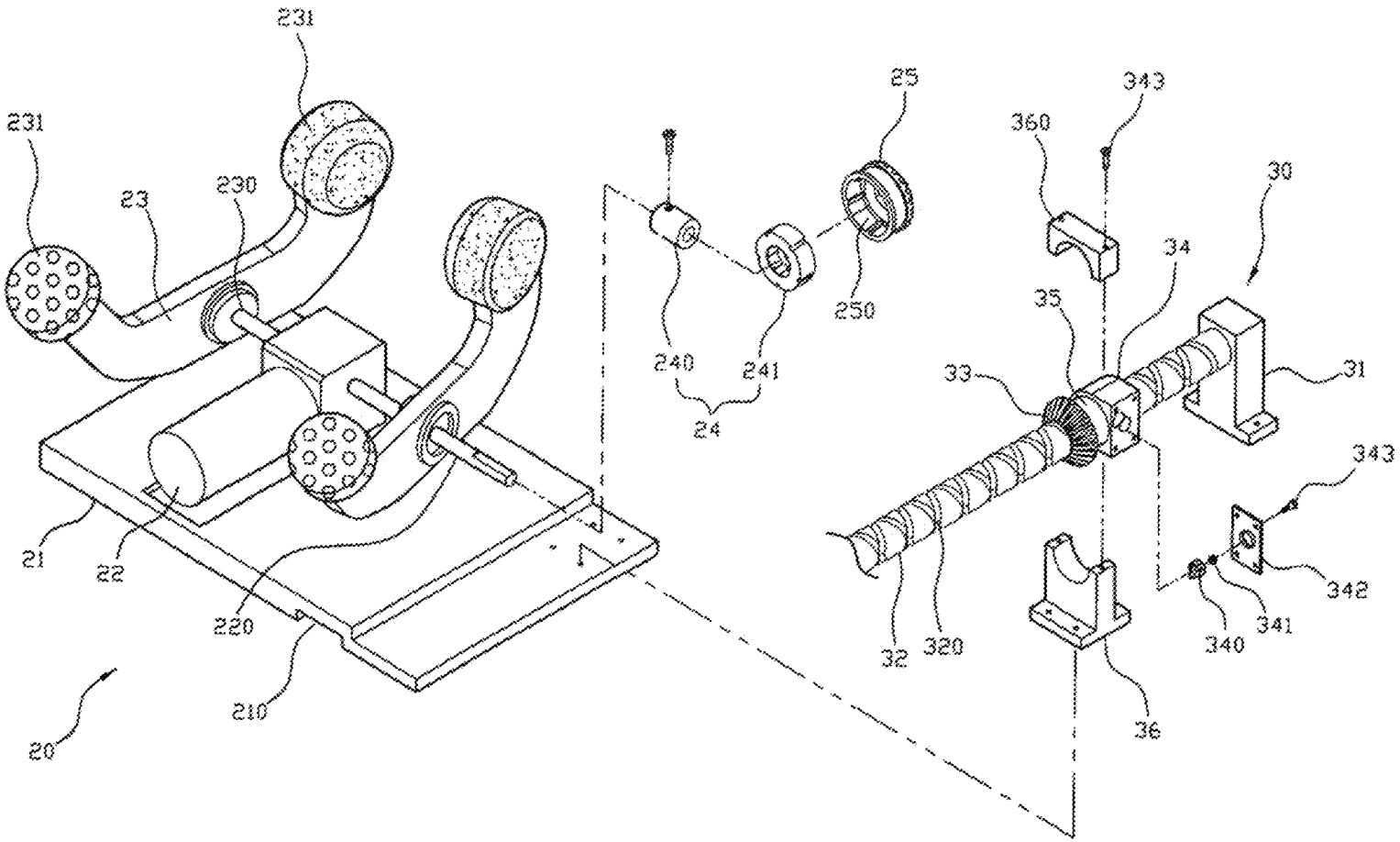
FIG. 4 is a partial exploded view of the present invention.

The assembly of the present invention is as shown in FIG. 3. The engaging recess (210) at the bottom of the main seat (21) is engaged with the first positioning plate (11) and one side of the main seat (21) is against the second positioning plate (12), such that the drive unit (20) can slide up and down on the base (10). The transmission unit (30) is secured on one side of the base (10). An accommodation groove (35) is defined between the second bevel gear (33) and the movable member (34). A fixed seat (36) having a concave upper end is secured on the main seat (21). The concave upper end of the fixed seat (36) is embedded in the accommodation groove (35). An upper cover (360) is disposed at an upper end of the accommodation groove (35) and secured on the fixed seat (36). The first bevel gear (25) meshes with the second bevel gear (33) to form a linkage relationship. The linkage member (340) inside the movable member (34) is engaged with the cross screw thread (320). A baffle plate (40) is provided above the drive member (22) of the drive unit (20). Upper and lower ends of the baffle plate (40) are positioned at the pair of notches (13) of the base (10).

Figure 5:
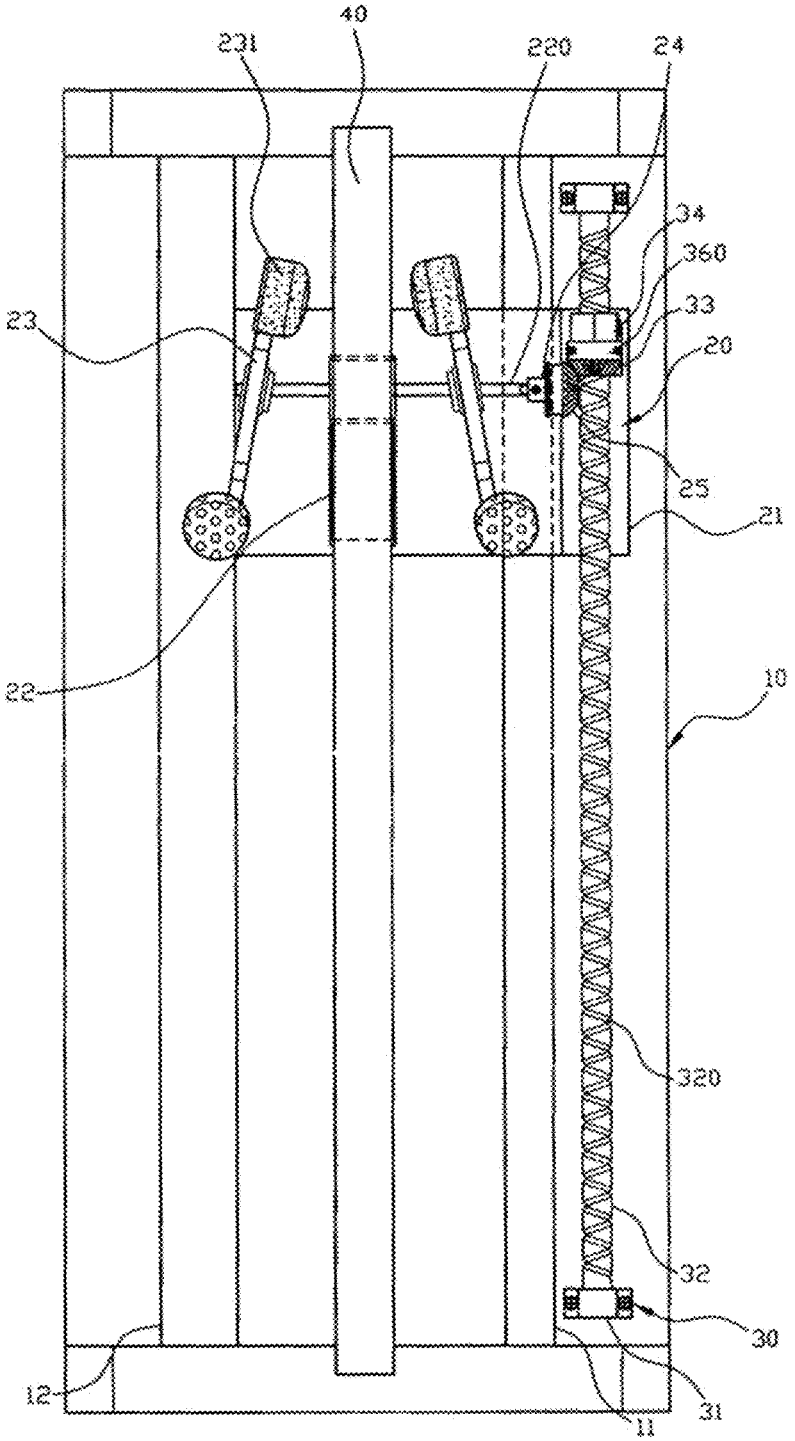
FIG. 5 is a top view of the present invention.

When in use, as shown in FIG. 5, the drive member (22) drives the rotary shaft (220) to rotate clockwise or counterclockwise. The rotary shaft (220) is connected with the massage members (23). The rotary shaft (220) is eccentrically connected with the pivot holes (230) of the massage members (23) so that the massage members (23) are eccentrically rotated about the pivot holes (230). The upper and lower ends of each massage member (23) are provided with the massage bodies (231). The massage bodies (231) are swung in the same arc with the swing of the massage members (23) to provide a shiatsu massage and a kneading massage.

Figure 6:
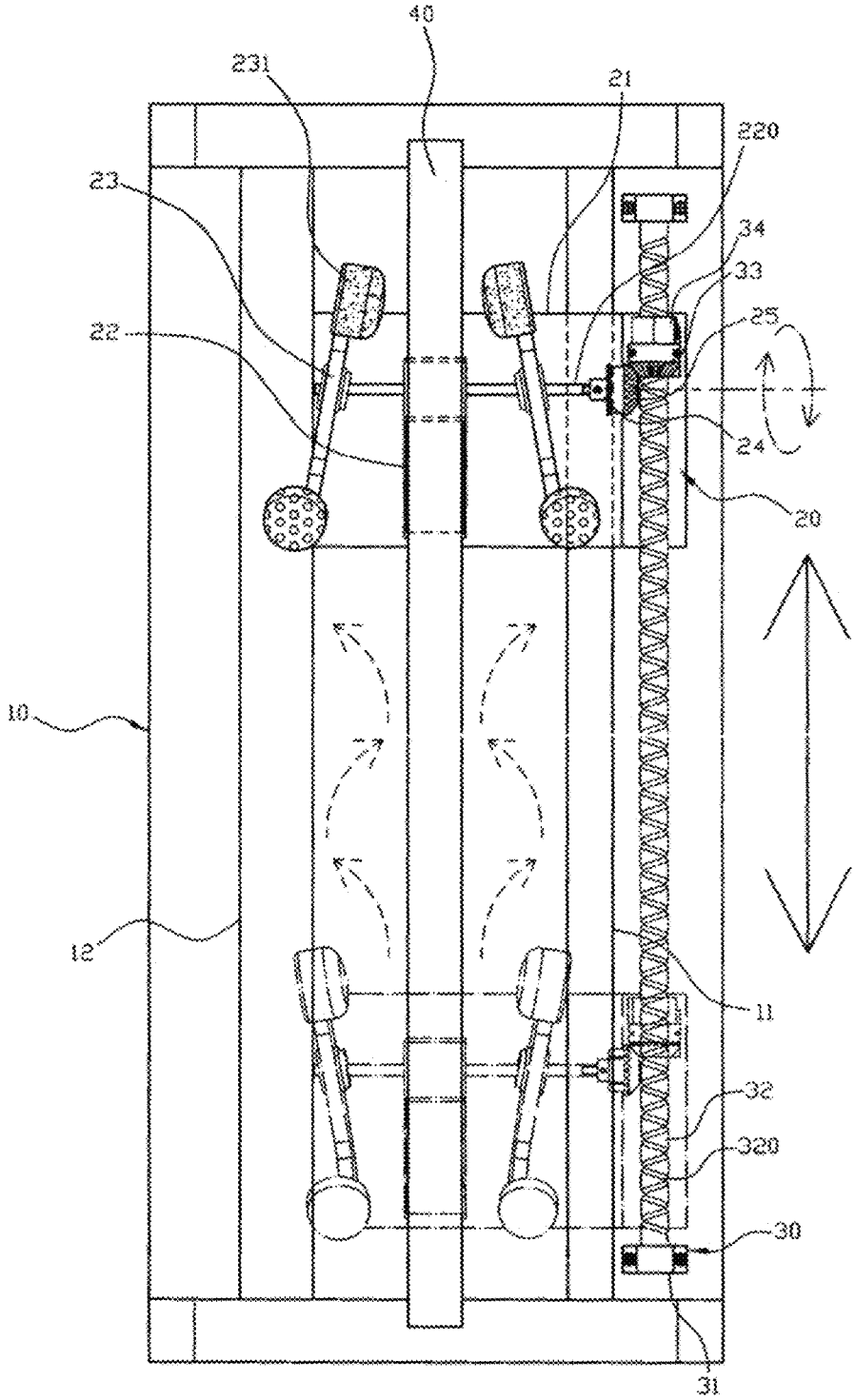
FIG. 6 is a schematic view of the present invention, showing that the drive unit slides on the base for performing a shiatsu massage and a kneading massage.
Figure 8:
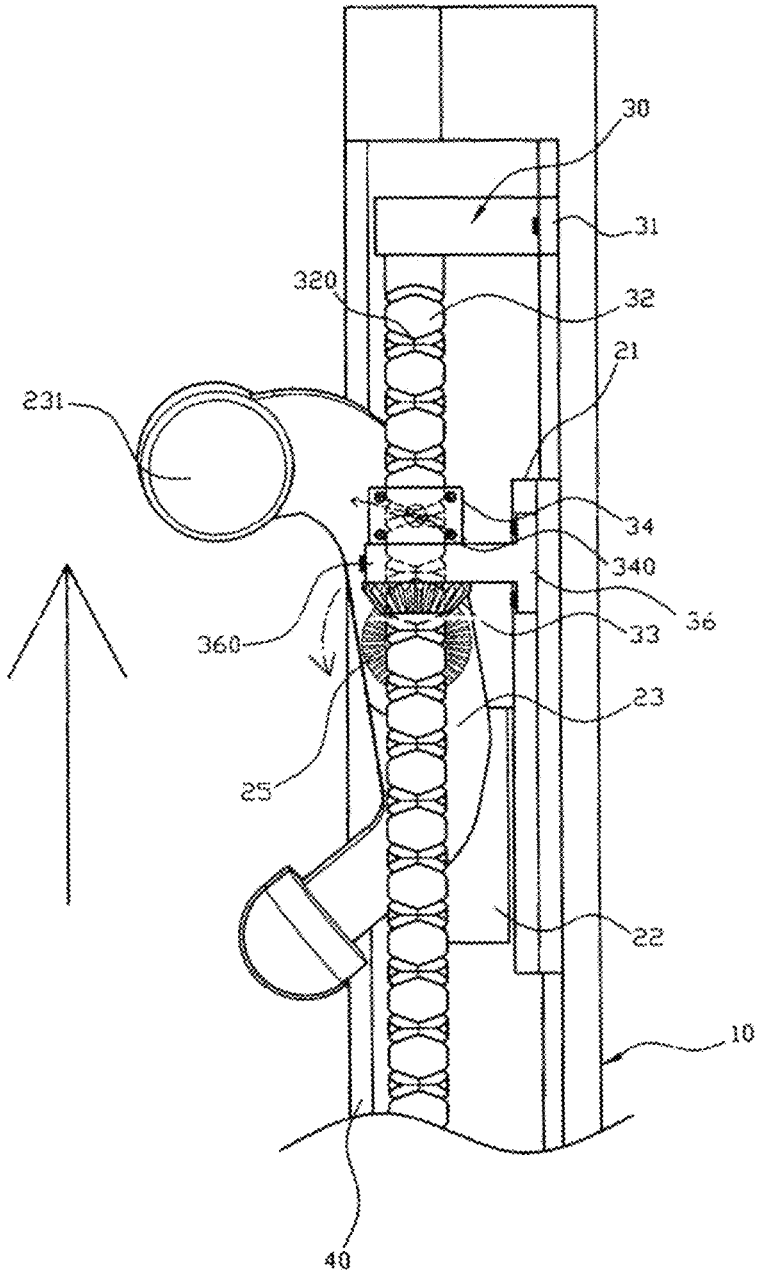
FIG. 8 is a schematic view of the present invention, showing that the linkage member is moved up along the cross screw thread.
Figure 9:
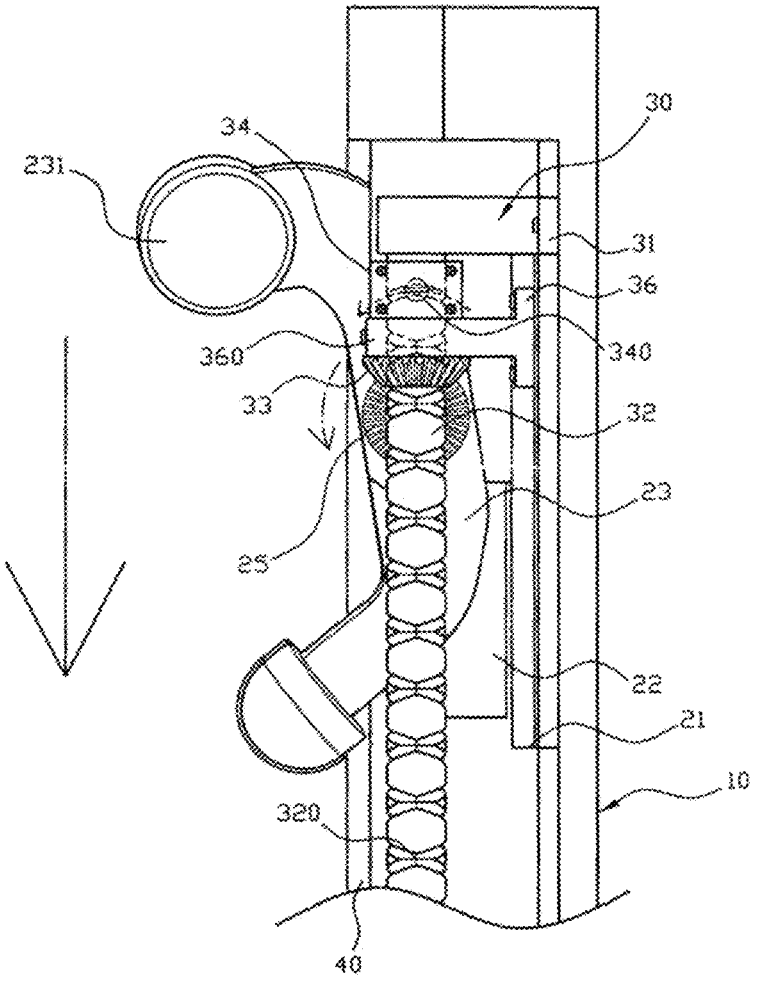
FIG. 9 is a schematic view of the present invention, showing that the linkage member is moved down along the cross screw thread.

FIG. 6 illustrates the operation mode of the massage device in a clockwise rotation. When the rotary shaft (220) is rotated clockwise, the first bevel gear (25) meshing with the unidirectional bearing (24) is driven to drive the second bevel gear (33) meshing with the first bevel gear (25). The movable member (34) is turned along with the rotation of the second bevel gear (33). The linkage member (340) inside the movable member (34) meshes with the cross screw thread (320) of the worm shaft (32), so that the movable member (34) is guided to move forward through the linkage member (340) meshing with the cross screw thread (320) while the movable member (34) is turned along with the second bevel gear (33). When the linkage member (340) is moved to the uppermost or lowermost end of the cross screw thread (320), the linkage member (340) is returned to keep going down or up through the uppermost or lowermost end of the cross screw thread (320). The fixed seat (36) and the upper cover (360) are located between the second bevel gear (33) and the movable member (34). The fixed seat (36) is fixed to the main seat (21). When the second bevel gear (33) and the movable member (34) are moved simultaneously, the fixed seat (36) is brought to move up and down so as to move the main seat (21), such that the drive unit (20) is reciprocated on the worm shaft (32) (referring to FIGS. 8 and 9) to obtain a movable massage.

Figure 7:
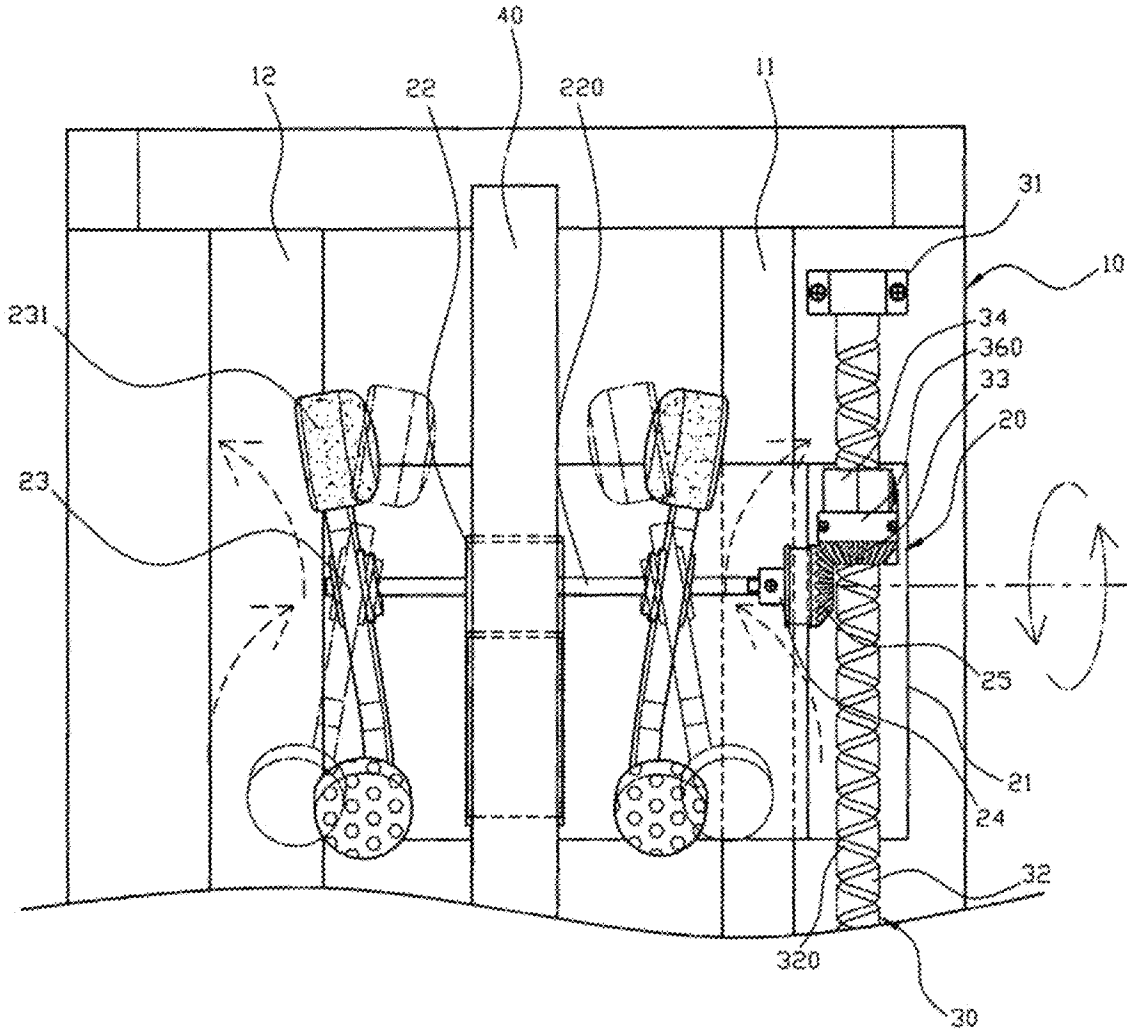
FIG. 7 is a schematic view of the present invention, showing that the drive unit is kept at a certain position for performing a shiatsu massage and a kneading massage.

FIG. 7 illustrates the operation mode of the massage device in a counterclockwise rotation. When the main seat (21) with the fixed seat (26) is brought to a certain position, the drive member (22) is switched to turn the rotary shaft (220) counterclockwise. The first bevel gear (25) coupled with the unidirectional bearing (24) is not driven because the unidirectional bearing (24) is idling. When the rotary shaft (220) is rotated counterclockwise, the massage members (23) are continuously operated, but the first bevel gear (25) is not driven. When the first bevel gear (25) is not driven, the second bevel gear (33), the movable member (34), and the fixed seat (36), arranged in sequence behind the first bevel gear (25), stop running to provide a fixed-point massage.

The massage device in accordance with the aforesaid embodiment has the following effects. The drive member (22) is used to rotate the rotary shaft (220) clockwise and counterclockwise. The unidirectional bearing (24) is driven in one direction only while the other direction is idling. When the unidirectional bearing (24) is idling, the linkage relationship between the rotary shaft (220) and the massage members (23) is interrupted. When the first and second bevel gears (25, 33) are driven to turn, the movable member (34), the fixed seat (36) and the upper cover (360), arranged in sequence behind the second bevel gear (33), are linked to move. Because the fixed seat (36) is disposed on the main seat (21), the entire drive unit (20) is moved by means of the traction of the worm shaft (32). Thereby, a movable massage or a fixed-point massage can be obtained by using the drive unit (20) only. It is only necessary to use the drive member (22) to achieve the same effect as the prior art. This is not only more cost-effective but also more competitive in industry.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A massage device comprising:

a base including a first positioning plate, a second positioning plate, and a pair of notches formed at upper and lower ends of the base, a drive unit including a main seat, an engaging recess arranged at a bottom of the main seat, a drive member provided on the main seat, a rotary shaft penetrating the drive member, a pair of massage members each rotatably mounted on a respective end of the rotary shaft in an eccentric manner, massage bodies ends mounted on opposed ends of each massage member, and a unidirectional bearing and a first bevel gear mounted on one end of the rotary shaft, and a transmission unit including two positioning blocks, a worm shaft connected between the two positioning blocks and formed with a cross screw thread thereon, a second bevel gear mounted on the worm shaft, a movable member mounted on the worm shaft and including a linkage member, an accommodation groove defined between the second bevel gear and the movable member, a fixed seat and an upper cover connected to the accommodation groove, the fixed seat being secured on the main seat, the first bevel gear meshing with the second bevel gear, and the linkage member being engaged with the cross screw thread, wherein the linkage member is biased by a spring, and wherein the spring abuts against a positioning piece fixed to the movable member with a screw.

2. The massage device as claimed in claim 1, wherein the engaging recess at the bottom of the main seat is engaged with the first positioning plate, one side of the main seat is arranged against the second positioning plate, and the drive member is configured to slide up and down on the base.

3. The massage device as claimed in claim 1, further comprising a baffle plate provided above the drive member of the drive unit, wherein upper and lower ends of the baffle plate are positioned at the pair of notches of the base.

4. The massage device as claimed in claim 1, wherein the linkage member meshes with the cross screw thread of the worm shaft, so that the movable member is guided to move forward through the linkage member meshing with the cross screw thread while the movable member is rotated along with the second bevel gear, when the linkage member is moved to an uppermost or lowermost end of the cross screw thread, the linkage member is returned to keep going down or up through the uppermost or lowermost end of the cross screw thread.

5. The massage device as claimed in claim 1, wherein the unidirectional bearing is driven in one direction only and another direction is idling, when the drive unit is turned in one direction, the main seat is moved along the worm shaft, when the drive unit is turned in the other direction, a linkage relationship between the rotary shaft and the massage members is interrupted.

6. The massage device as claimed in claim 1, wherein the fixed seat has a concave upper end, the concave upper end of the fixed seat is embedded in the accommodation groove, and the upper cover is disposed at an upper end of the accommodation groove and secured on the fixed seat.

* * * * *